United States Patent [19]

Evans et al.

[11] Patent Number: 4,769,360

[45] Date of Patent: Sep. 6, 1988

[54] CYAN DYE-DONOR ELEMENT FOR THERMAL DYE TRANSFER

[75] Inventors: Steven Evans, Rochester; Helmut Weber, Webster, both of N.Y.

[73] Assignee: Eastman Kodak Company, Rochester, N.Y.

[21] Appl. No.: 95,796

[22] Filed: Sep. 14, 1987

[51] Int. Cl.[4] ..... B41M 5/035; B41M 5/26

[52] U.S. Cl. ..... 503/227; 8/471; 427/146; 427/256; 428/195; 428/480; 428/913; 428/914; 430/945

[58] Field of Search ..... 8/470, 471; 427/146, 427/256; 428/195, 207, 480, 913, 914; 430/945; 503/227

[56] References Cited

U.S. PATENT DOCUMENTS 4,695,287 9/1987 Evans et al. ..... 8/471

FOREIGN PATENT DOCUMENTS 147747 7/1985 European Pat. Off. ..... 503/227
239289 11/1985 Japan ..... 503/227
268493 11/1986 Japan ..... 503/227

*Primary Examiner*—Bruce H. Hess
*Attorney, Agent, or Firm*—Harold E. Cole

[57] ABSTRACT

A cyan dye-donor element for thermal dye transfer comprises a support having thereon a dye of cyan hue dispersed in a polymeric binder, the dye having the formula:

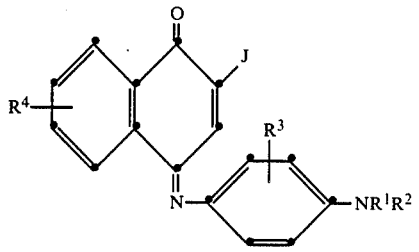

wherein $R^1$ and $R^2$ are substituted or unsubstituted alkyl, cycloalkyl or aryl;

$R^3$ and $R^4$ are hydrogen, substituted or unsubstituted alkyl, halogen, —$NHCOR^1$ or —$NHSO_2R^1$; and J is —C≡N, —Cl, —$NHCOR^1$, —$NHCO_2R^1$, —$NHCONHR^1$, —$NHCON(R^1)_2$, —$SO_2NHR^1$, —$NHSO_2R^1$, or

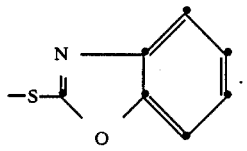

19 Claims, No Drawings

CYAN DYE-DONOR ELEMENT FOR THERMAL DYE TRANSFER

This invention relates to cyan dye-donor elements used in thermal dye transfer which have good hue and dye stability.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of certain dyes in dye-donor elements for thermal dye transfer printing. Many of the dyes proposed for use do not have adequate stability to light. Others do not have good hue. It would be desirable to provide dyes of cyan hue which have good light stability and have improved hues.

European patent application No. 147,747 relates to a dye-receiving element for thermal dye transfer printing. It also has a general disclosure of dyes for dye-donor elements useful therewith. Included within this general disclosure is a description of quinoneimine dyes produced by the oxidative coupling reaction of a p-phenylenediamine derivative with a phenol or naphthol. No specific naphthol compounds are illustrated.

JP No. 60/239,289 and U.S. Ser. No. 911,839, filed Sept. 26, 1986, now U.S. Pat. No. 4,695,287, disclose cyan naphthoquinoneimine dyes with a 2-carbamoyl group used in a thermal transfer sheet. There is no disclosure in these references, however, that these dyes could be substituted with groups other than a 2-carbamoyl group. It would be desirable to provide such dyes with groups other than a 2-carbamoyl group in order to increase synthetic flexibility, improve cyan hue and improve the stability to light and heat.

JP No. 61/268,493 discloses cyan naphthoquinoneimine dyes with a 2-carbamoyl group along with other groups used in a thermal transfer sheet. It would be desirable to provide such dyes with other groups in the 2-position in order to increase synthetic flexibility, improve cyan hue and improve the stability to light and heat.

Substantial improvements in light stability and hues are achieved in accordance with this invention which comprises a cyan dye-donor element for thermal dye transfer comprising a support having thereon a dye layer comprising a dye of cyan hue dispersed in a polymeric binder, the dye having the formula:

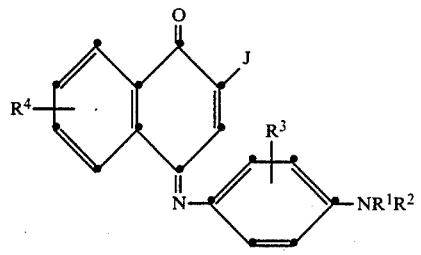

wherein $R^1$ and $R^2$ are each independently substituted or unsubstituted alkyl of from 1 to about 6 carbon atoms such as methyl, ethyl, propyl, isopropyl, butyl, pentyl, hexyl, methoxyethyl, benzyl, 2-methanesulfonamidoethyl, 2-hydroxyethyl, 2-cyanoethyl, methoxycarbonylmethyl, etc.; substituted or unsubstituted cycloalkyl of from about 5 to about 7 carbon atoms such as cyclohexyl, cyclopentyl, etc.; or substituted or unsubstituted aryl of from about 5 to about 10 carbon atoms such as phenyl, pyridyl, naphthyl, p-tolyl, p-chlorophenyl, m-(N-methyl sulfamoyl)phenyl, etc.;

$R^3$ and $R^4$ are hydrogen; substituted or unsubstituted alkyl of from 1 to about 6 carbon atoms such as methyl, ethyl, propyl, isopropyl, butyl, pentyl, hexyl, methoxyethyl, 2-cyanoethyl, benzyl, 2-hydroxyethyl, 2-methanesulfonamidoethyl, etc.; halogen such as chlorine, bromine, or fluorine; $—NHCOR^1$ or $—NHSO_2R^1$; and J is —C≡N, —Cl, $—NHCOR^1$, $—NHCO_2R^1$, $—NHCONHR^1$, $—NHCON(R^1)_2$, $—SO_2NHR^1$, $—NHSO_2R^1$, or

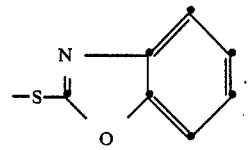

Compounds included within the scope of the invention include the following:

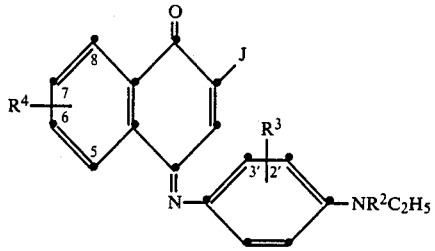

| Compound No. | $R^2$ | $R^3$ | $R^4$ | J |
|---|---|---|---|---|
| 1 | $-C_2H_5$ | H | 5-$NHCOCH_3$ | $-SO_2NHCH_3$ |
| 2 | $-C_2H_5$ | H | 5-$NHSO_2CH_3$ | $-SO_2NHC_4H_9-n$ |
| 3 | $-C_2H_5$ | H | H | $-SO_2NH(CH_2)_2C_6H_5$ |
| 4 | $-C_2H_5$ | H | H | $-SO_2NHCH_3$ |
| 5 | $-C_2H_5$ | H | H | $-NHCOCH_3$ |
| 6 | $-C_2H_5$ | H | H | $-CN$ |
| 7 | $-C_2H_5$ | H | 5-$NHCOCH_3$ | $-CN$ |
| 8 | $-C_2H_4NHSO_2CH_3$ | 3'-$CH_3$ | H | $-CN$ |
| 9 | $-C_2H_5$ | 3'-$CH_3$ | H | $-SO_2NH(CH_2)_2C_6H_5$ |
| 10 | $-C_2H_5$ | 3'-$CH_3$ | H | $-NHCO_2C_2H_5$ |
| 11 | $-C_2H_5$ | H | H | $-Cl$ |
| 12 | $-C_2H_5$ | H | H | 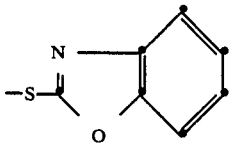 |
| 13 | $-C_2H_5$ | 3'-$CH_3$ | H | 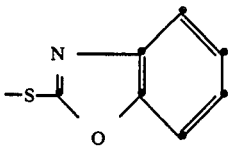 |
| 14 | $-C_2H_5$ | 3'-$CH_3$ | H | $-Cl$ |
| 15 | $-CH_3$ | 3'-$CH_3$ | 6-$CH_3$ | $-NHCONHCH_3$ |
| 16 | $-C_2H_4OH$ | 3'-$CH_3$ | 8-$NHCOCH_3$ | $-SO_2NH(C_2H_5)$ |
| 17 | $-CH_2CO_2CH_3$ | 3'-$NHCOCH_3$ | 5-Cl | $-SO_2NH(C_6H_5)$ |
| 18 | $-nC_6H_{13}$ | 2'-Cl | 5-OH | $-NHCON(C_2H_5)_2$ |
| 19 | $-nC_6H_{13}$ | H | 5-$OCH_3$ | $-SO_2NH(CH_2C_6H_5)$ |
| 20 | $-C_2H_4OH$ | H | H | $-NHCOC_6H_5$ |
| 21 | $-C_2H_4CN$ | 3'-$NHSO_2CH_3$ | 8-$NHSO_2CH_3$ | $-CN$ |
| 22 | $-CH_2C_6H_5$ | 2'-Cl | 7-Cl | $-NHSO_2C_6H_5$ |
| 23 | $-CH_2C_6H_5$ | 3'-$C_2H_4NHSO_2CH_3$ | 6-$CH_3$ | $-CN$ |

A dye-barrier layer may be employed in the dye-donor elements of the invention to improve the density of the transferred dye. Such dye-barrier layer materials include hydrophilic materials such as those described and claimed in application Ser. No. 934,969 entitled "Dye-Barrier and Subbing Layer for Dye-Donor Element Used in Thermal Dye Transfer" by Vaniem, Lum and Bowman, filed Nov. 25, 1986.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-coacrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 2 to about 30 μm. It may also be coated with a subbing layer, if desired.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or a continuous roll or ribbon. If a continuous roll or ribbon is employed, it may have only the cyan dye thereon as described above or may have alternating areas of other different dyes, such as sublimable magenta and/or yellow and/or black or other dyes. Such dyes are disclosed in U.S. Pat. No. 4,541,830, the disclosure of which is hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of magenta, yellow and the cyan dye as described above, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled part. A second dye-donor element (or another area of the donor element with a different dye area) is then brought in register with the dye-receiving element and the process repeated. The third color is obtained in the same manner.

The following examples are provided to illustrate the invention.

EXAMPLE 1

A cyan dye-donor element was prepared by coating on a 6 μm poly(ethylene terephthalate) support a dye layer containing a cyan dye as identified above or in Table 1 below (0.77 mmoles/m$^2$), and FC-434® (3M Corp.) surfactant (2.2 mg/m$^2$) in a cellulose acetate propionate (40% acetyl and 17% propionyl) binder (at 1.8 times that of the cyan dye) coated from a toluene, methanol and cyclopentanone solvent mixture. On the back side of the element was coated a slipping layer of the type disclosed in copending U.S. patent application Ser. No. 923,442 of Henzel et al, filed Oct. 27, 1986.

A dye-receiving element was prepared by coating a solution of Makrolon 5705® (Bayer A.G. Corporation) polycarbonate resin (2.9 g/m$^2$) in a methylene chloride and trichloroethylene solvent mixture of an ICI Melinex 990® white polyester support for density evaluations or on a transparent poly(ethylene terephthalate) film support for spectral absorption evaluations.

The dye side of the dye-donor element strip one inch (25 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a TDK Thermal Head L-133 (No. C6-0242) and was pressed with a spring at a force of 8 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head was heated at increments from 0 up to 8.3 msec to generate a graduated density test pattern. The voltage supplied to the print head was approximately 21 v representing approximately 1.7 watts/dot (12 mjoules/dot).

The dye-receiving element was separated from the dye-donor element and the Status A red reflection density of the step image was read. The image was then subjected to "HID-fading": 7 days, 50 kLux, 5400° K., 32° C., approximately 25% RH. The % density loss at maximum transferred density was calculated.

The light absorption spectra from 400 to 700 nm were also obtained after transfer of an area of the dye to the transparent support receiver in the manner indicated above. From a computer normalized 1.0 density curve, the λ-max was calculated.

The following results were obtained:

TABLE 1

| Dye | λ-max (nm) | % Density Loss From D-max |
|---|---|---|
| Compound 1 | 665 | 6 |
| Compound 2 | 669 | 7 |
| Compound 3 | 657 | 11 |
| Compound 4 | 659 | 10 |
| Compound 5 | 658 | 4 |
| Compound 6 | 677 | 7 |
| Compound 7 | 684 | 6 |
| Compound 8 | 682 | 11 |
| Compound 9 | 684 | 8 |
| Compound 10 | 632 | 6 |
| Compound 11 | 617 | 10 |
| Compound 12 | 634 | 7 |
| Compound 13 | 654 | 12 |
| Compound 14 | 638 | 13 |
| Control 1 | 592 | 14 |
| Control 2 | 664 | 44 |
| Control 3 | 657 | 37 |
| Control 4 | 604 | 44 |
| Control 5 | 621 | 100 |
| Control 6 | 673 | 54 |

Control Compounds

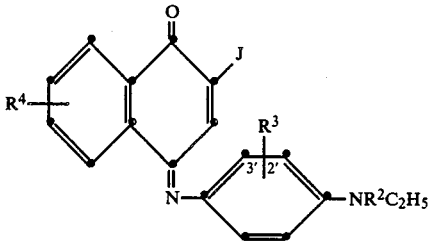

| Control Compound No. | $R^2$ | $R^3$ | $R^4$ | J |
|---|---|---|---|---|
| 1 | $-C_2H_5$ | H | H | H |
| 2 | $-C_2H_5$ | H | H | $-SO_2C_4H_9-n$ |
| 3 | $-C_2H_5$ | H | H | $-SCN$ |
| 4 | $-C_2H_4NHSO_2CH_3$ | H | H | $-SCN$ |
| 5 | $-C_2H_5$ | H | H | $-CON(CH_3)_2$ |
| 6 | $-C_2H_5$ | 3'-$CH_3$ | H | $-SO_2N(CH_3)_2$ |

The above results indicate that the cyan dyes of the invention had much better light stability than the control dyes.

EXAMPLE 2

Preparation of Compound 6

N-(p-diethylamino)phenyl-2-cyano-1,4-naphthoquinone

A solution of 2-cyano-1-naphthol (1.0 g, 5.92 mmole) in 35 mL ethyl acetate was mixed with a solution of N,N-diethyl-p-phenylenediamine hydrochloride (1.2 g, 5.92 mmole) in 35 mL of distilled water. The two-phase system was rapidly stirred while solid sodium carbonate (6.3 g, 0.059 mole) was added in portions. Then a solution of 9.9 g (0.03 mole) potassium ferricyanide in approximately 35 mL distilled water was added dropwise over 5 minutes. The reaction was stirred 3 hours at room temperature and then filtered through a pad of diatomaceous earth, and rinsed with methylene chloride to redissolve some dye which had precipitated from the reaction.

The filtrate was transferred to a separatory funnel, the layers separated and the organic phase washed three times with distilled water. The organic phase was dried over magnesium sulfate and passed over a short (3 inch diameter×2 inch height) column of silica gel (Woelm TSC) and evaporated to dryness. Crystallization of the crude product from 50 mL of methanol yielded 1.8 g (92% of theory) of purple crystals, m.p. 153°-155° C.

The invention has been described in detail with particular reference to preferred embodiments thereof, but it will be understood that variations and modifications can be effected within the spirit and scope of the invention.

What is claimed is:

1. A cyan dye-donor element for thermal dye transfer comprising a support having thereon a dye layer comprising a dye of cyan hue dispersed in a polymeric binder, said dye having the formula:

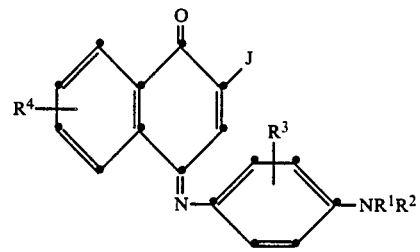

wherein $R^1$ and $R^2$ are each independently substituted or unsubstituted alkyl of from 1 to about 6 carbon atoms; substituted or unsubstituted cycloalkyl of from about 5 to about 7 carbon atoms; or substituted or unsubstituted aryl of from about 5 to about 10 carbon atoms;

$R^3$ and $R^4$ are each independently hydrogen; substituted or unsubstituted alkyl of from 1 to about 6 carbon atoms; halogen; $-NHCOR^1$ or $-NHSO_2R^1$; and J is $-C{\equiv}N$, $-Cl$, $-NHCOR^1$, $-NHCO_2R^1$, $-NHCONHR^1$, $-NHCON(R^1)_2$, $-SO_2NHR^1$, $-NHSO_2R^1$, or

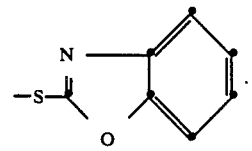

2. The element of claim 1 wherein both $R^1$ and $R^2$ are ethyl.

3. The element of claim 1 wherein $R^3$ is hydrogen or methyl.

4. The element of claim 1 wherein $R^4$ is hydrogen, $-NHCOCH_3$, or $-NHSO_2CH_3$.

5. The element of claim 1 wherein J is $-SO_2NHR^1$.

6. The element of claim 1 wherein J is $-C{\equiv}N$.

7. The element of claim 1 wherein a dye-barrier layer is located between said dye layer and said support.

8. The element of claim 1 wherein the side of the support opposite the side having thereon said dye layer is coated with a slipping layer comprising a lubricating material.

9. The element of claim 1 wherein said support comprises poly(ethylene terephthalate).

10. The element of claim 1 wherein said dye layer comprises sequential repeating areas of magenta, yellow and said cyan dye.

11. In a process of forming a cyan dye transfer image comprising imagewise-heating a dye-donor element comprising a support having thereon a dye layer comprising a dye of cyan hue dispersed in a polymeric binder and transferring a cyan dye image to a dye-receiving element to form said cyan dye transfer image, the improvement wherein said dye has the formula:

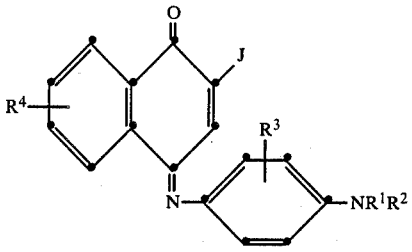

wherein $R^1$ and $R^2$ are each independently substituted or unsubstituted alkyl of from 1 to about 6 carbon atoms; substituted or unsubstituted cycloalkyl of from about 5 to about 7 carbon atoms; or substituted or unsubstituted aryl of from about 5 to about 10 carbon atoms;

$R^3$ and $R^4$ are each independently hydrogen; substituted or unsubstituted alkyl of from 1 to about 6 carbon atoms; halogen; —$NHCOR^1$ or —$NHSO_2R^1$; and J is —C≡N, —Cl, —$NHCOR^1$, —$NHCO_2R^1$, —$NHCONHR^1$, —$NHCON(R^1)_2$, —$SO_2NHR^1$, —$NHSO_2R^1$, or

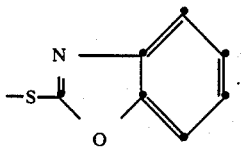

12. The process of claim 11 wherein said support is poly(ethylene terephthalate) which is coated with sequential repeating areas of magenta, yellow and said cyan dye, and said process steps are sequentially performed for each color to obtain a three-color dye transfer image.

13. In a thermal dye transfer assemblage comprising:

(a) a cyan dye-donor element comprising a support having thereon a dye layer comprising a dye of cyan hue dispersed in a polymeric binder, and (b) a dye-receiving element comprising a support having thereon a dye image-receiving layer, said dye-receiving element being in a superposed relationship with said cyan dye-donor element so that said dye layer is in contact with said dye image-receiving layer, the improvement wherein said dye has the formula:

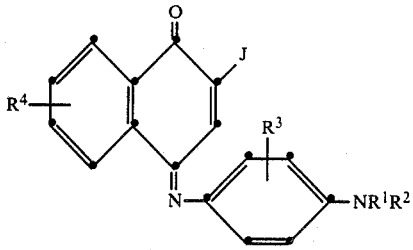

wherein $R^1$ and $R^2$ are each independently substituted or unsubstituted alkyl of from 1 to about 6 carbon atoms; substituted or unsubstituted cycloalkyl of from about 5 to about 7 carbon atoms; or substituted or unsubstituted aryl of from about 5 to about 10 carbon atoms;

$R^3$ and $R^4$ are each independently hydrogen; substituted or unsubstituted alkyl of from 1 to about 6 carbon atoms; halogen; —$NHCOR^1$ or —$NHSO_2R^1$; and J is —C≡N, —Cl, —$NHCOR^1$, —$NHCO_2R^1$, —$NHCONHR^1$, —$NHCON(R^1)_2$, —$SO_2NHR^1$, —$NHSO_2R^1$, or

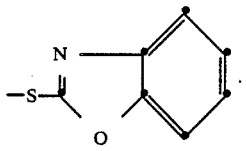

14. The assemblage of claim 13 wherein both $R^1$ and $R^2$ are ethyl.

15. The assemblage of claim 13 wherein $R^3$ is hydrogen or methyl.

16. The assemblage of claim 13 wherein $R^4$ is hydrogen, —$NHCOCH_3$, or —$NHSO_2CH_3$.

17. The assemblage of claim 13 wherein J is —$SO_2NHR^1$.

18. The assemblage of claim 13 wherein J is —C≡N.

19. The assemblage of claim 13 wherein said support of the dye-donor element comprises poly(ethylene terephthalate).

* * * * *